US008671821B1

(12) United States Patent
Zank et al.

(10) Patent No.: US 8,671,821 B1
(45) Date of Patent: Mar. 18, 2014

(54) METHOD OF PROVIDING A DEFENSE AGAINST A SHAPED CHARGE

(75) Inventors: Paul A. Zank, Brookline, NH (US); Daniel J. Long, Amherst, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 13/609,338

(22) Filed: Sep. 11, 2012

Related U.S. Application Data

(60) Division of application No. 13/186,823, filed on Jul. 20, 2011, now Pat. No. 8,281,701, which is a division of application No. 12/231,491, filed on Sep. 2, 2008, now Pat. No. 8,006,608, which is a division of application No. 11/156,770, filed on Jun. 20, 2005, now Pat. No. 7,424,845, and a continuation-in-part of application No. PCT/US2005/020571, filed on Jun. 10, 2005, which is a continuation-in-part of application No. 10/871,146, filed on Jun. 18, 2004, now Pat. No. 7,104,178, which is a continuation-in-part of application No. 10/323,383, filed on Dec. 18, 2002, now Pat. No. 6,758,125.

(60) Provisional application No. 60/580,808, filed on Jun. 18, 2004.

(51) Int. Cl.
*F41H 5/007* (2006.01)

(52) U.S. Cl.
CPC ..... *F41H 5/007* (2013.01)
USPC ..... 89/36.17; 89/902

(58) Field of Classification Search
CPC ..... F41H 5/007
USPC ..... 89/36.17, 902
See application file for complete search history.

(56) References Cited

U.S. PATENT DOCUMENTS

| | | | | |
|---|---|---|---|---|
| 3,592,148 | A * | 7/1971 | Manis | 109/37 |
| 4,051,763 | A | 10/1977 | Thomanek | |
| 4,158,368 | A | 6/1979 | Clark | |
| 5,915,291 | A * | 6/1999 | Weihrauch et al. | 89/36.01 |
| 5,922,986 | A | 7/1999 | Wanninger et al. | |
| 6,029,558 | A | 2/2000 | Stevens et al. | |
| 6,327,955 | B1 * | 12/2001 | Kerdraon et al. | 89/36.17 |
| 8,020,483 | B2 * | 9/2011 | Benyami et al. | 89/36.17 |
| 2006/0162539 | A1 * | 7/2006 | Fucke et al. | 89/36.17 |

FOREIGN PATENT DOCUMENTS

| | | | | |
|---|---|---|---|---|
| GB | 2 234 334 A * | 1/1991 | | 89/36.17 |
| GB | 2234334 | 1/1991 | | |

* cited by examiner

*Primary Examiner* — Stephen M Johnson
(74) *Attorney, Agent, or Firm* — Daniel J. Long

(57) ABSTRACT

A method of providing a defense against a shaped charge uses an outer and an inner armor layer provided with a medial space between these outer and inner armor layers. One or more defensive shaped charges are positioned in the medial space. If the outer armor layer is attacked by ordnance having an offensive shaped charge, one or more of the defensive shaped charges positioned in the medial space is detonated so as to degrade the effectiveness of the offensive shaped charge and prevent penetration of the inner armor layer.

6 Claims, 2 Drawing Sheets

METHOD OF PROVIDING A DEFENSE AGAINST A SHAPED CHARGE

CROSS REFERENCE TO RELATED APPLICATIONS

This application claims rights under 35 U.S.C. §119(e) from U.S. Application Ser. No. 60/580,808, filed Jun. 18, 2004 by Paul A. Zank et al. entitled "Active Armor", the contents of which are incorporated herein by reference.

This application is a divisional of U.S. Ser. No. 13/186,823, filed Jul. 20, 2011; now U.S. Pat. No. 8,281,701; which is a divisional of U.S. Ser. No. 12/231,491, filed Sep. 2, 2008; now U.S. Pat. No. 8,006,608; which is a divisional of U.S. Ser. No. 11/156,770, filed Jun. 20, 2005; now U.S. Pat. No. 7,424, 845; which is a continuation-in-part of U.S. Ser. No. 10/871, 146, filed Jun. 18, 2004; now U.S. Pat. No. 7,104,178; which is a continuation-in-part of U.S. Ser. No. 10/323,383, filed Dec. 18, 2002; now U.S. Pat. No. 6,758,125; which is a continuation-in-part of U.S. serial number PCT/US 2005/ 020571, filed Jun. 10, 2005, all of which applications are by Paul A. Zank and entitled "Method of Providing a Defense Against a Shaped Charge" or "Active Armor Including Medial Layer for Producing an Electric or Magnetic Field", the contents all of which are incorporated herein by reference.

BACKGROUND OF THE INVENTION

1. Field of the Invention

The present invention relates to armaments and more particularly to reactive and active armor.

2. Brief Description of Prior Developments

The prior art discloses various arrangements of active and reactive armor in which a medial layer is positioned between an outer and inner armor layer with a medial explosive or nonexplosive layer which disrupts a shaped charge to prevent its penetration of the overall armor system.

U.S. Pat. No. 4,368,660, for example, discloses an arrangement in which an explosive charge is positioned between two armor layers. On detonation of the explosive, the armor layers are displaced from one another to disrupt the shaped charge jet.

Systems which disrupt the shaped charge jet may not be entirely suitable for use on relatively lightly armored vehicles since the inner armor layer will have to be substantial enough to protect the occupants of the vehicle from the force generated by the detonation of the explosive layer itself.

A need, therefore, exists for an active armor system which is suitable for use on relatively lightly armored vehicle.

Unarmored military vehicles may also vulnerable to shaped charge weapons. Retrofitting such vehicles with an outer explosive layer to disrupt high the shaped charge jet may not be a satisfactory solution.

A need, therefore, exists for an active armor system which may be retrofitted on an unarmored vehicle.

SUMMARY OF THE INVENTION

The present invention is an active armor system which includes an outer and an inner armor layer with a medial space between these inner and outer armor layers layer. One or more relatively small shaped charges are positioned on the inner armor layer in the medial space. If the outer armor layer is struck by a projectile having a shaped charge, one or more of the small shaped charges positioned in the medial space near where the projectile has struck the outer armor layer are detonated. The small shaped charges in the medial space are positioned so that when they are detonated, their jets will tend to intersect with or be oppositely directed to the jet from the shaped charge on the projectile. The small shaped charges in the medial space may be detonated by an electrical current produced when a piezoelectric material, an electrostrictive material, or a magnetostrictive material in the outer armor layer is struck by the projectile. Alternatively, the small shaped charges in the medial space may be detonated as a result of being contacted by the jet of the detonated shaped charge on the projectile. The small shaped charges in the medial space may be used in conjunction with the electrical or magnetic fields described in the related applications cited above to disrupt the jet of the shaped charge on the projectile.

BRIEF DESCRIPTION OF THE DRAWINGS

The present invention is further described with reference to the accompanying drawings in which.

DETAILED DESCRIPTION OF THE PREFERRED EMBODIMENTS

Figure 1:
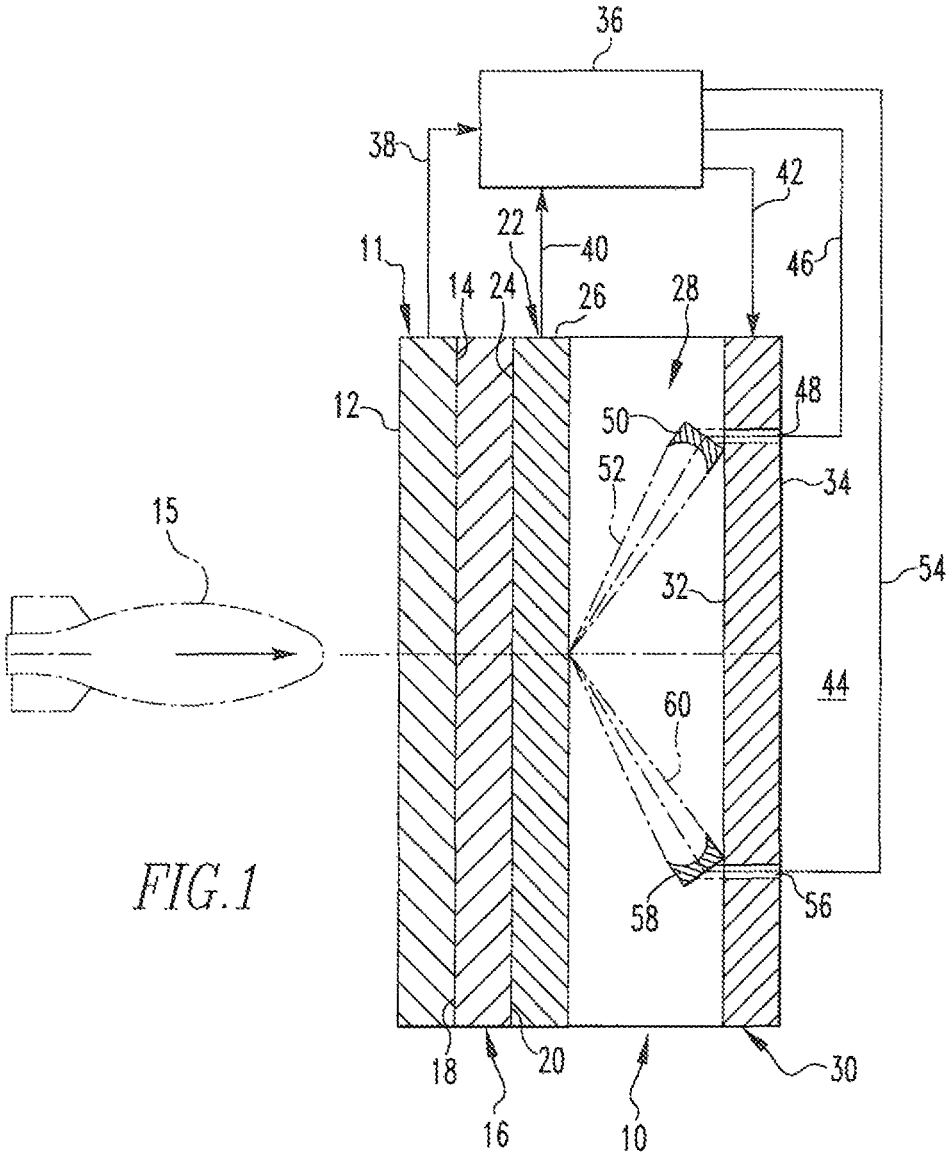
FIG. 1 is a vertical cross sectional view of a preferred embodiment of the active armor system of the present invention.

Referring to FIG. 1, the active armor system of the present invention is shown generally at numeral 10. This active armor system 10 includes a front armor layer 11 which would preferably consist of a suitable steel alloy or some other ferromagnetic material. The front armor layer 11 has a front face 12 and a rear face 14. The conventional shaped charge projectile 15, against which this system is designed to protect, travels in the direction of the arrow and would ordinarily be expected to impact against the front face 12 of the outer armor layer 11. Adjacent the front armor layer 11 there is an interior layer 16 which includes a front face and a rear face 20. This front face would abut the rear face of the front armor layer 11. The interior layer 16 is comprised of a suitable piezoelectric, electrostrictive, or magnetostrictive material, and specific preferred materials are disclosed in the above cited related applications. For the purpose of this disclosure, it will be understood that the term "projectile" as used herein will encompass any ordnance capable of being armed with a shaped charge which may be a shell, rocket propelled grenade (RPG), missile, air delivered bomb, land or water mine, or improvised explosive device (LED).

Inwardly adjacent the interior layer 16 there is an electrode 22 which has a front face 24 and a rear face 26. The front face 24 of electrode 22 would abut the rear face 20 of interior layer 16. Inwardly adjacent the rear face 26 of electrode 22 there is an interior air space 28. Alternatively, this air space 28 may be a vacuum space or may be a space filled with a inert gas. On the rear side of the armor system there is a rear armor layer 30 which has a front face 32 and a rear face 34. Armor layer 11 is electrically connected to solid state power converter 36 by line 38. Layer 26 is electrically connected to solid state power converter 36 by line 40. The front face 32 is adjacent air space 38 and the rear face 34 is adjacent a space to be protected 44 as, for example, the interior compartment of a tank or armored personnel carrier.

There is also a line 46 from power converter 36 to detonator 48 which is connected to shaped charge 50. Shaped charge 50 is tilted so that when it is detonated it produces an angularly oriented jet 52 which would intersect the jet (not shown) of the projectile 15 when projectile 15 strikes the outer armor layer 11. There is also a line 54 from power converter 36 to detonator 56 which is connected to shaped charge 58. Shaped charge 58 is tilted so that when it is detonated it produces an angularly oriented jet 60 which would intersect the jet (not shown) of the projectile 15 when projectile 15 strikes the outer armor layer 11. It will be seen that the jets 52 and 60 are interlocking so as to protect a relatively large area from projectile 15.

In operation, when a shaped charge projectile as, for example, projectile 15 impacts the front face 12 of the front armor layer 11, the force of that impact is transmitted through the front armor layer 11 to the interior layer 16. An electrical charge is transmitted to the electrode 22 which produces an electrical field which would tend to disrupt the jet (not shown) of the shaped charge of the projectile 15. Sufficient electrical current would also be produced to activate detonators 48 and 56 to detonate shaped charges 50 and 58 respectively to produce the interlocking jets 52 and 60 which would also disrupt the jet (not shown) from the projectile 15. It will be understood that the interlocking jets 52 and 60 may be used alone to disrupt the jet (not shown) from the projectile 15 in a system in which an electrical field in medial space 28 is not produced.

Figure 2:
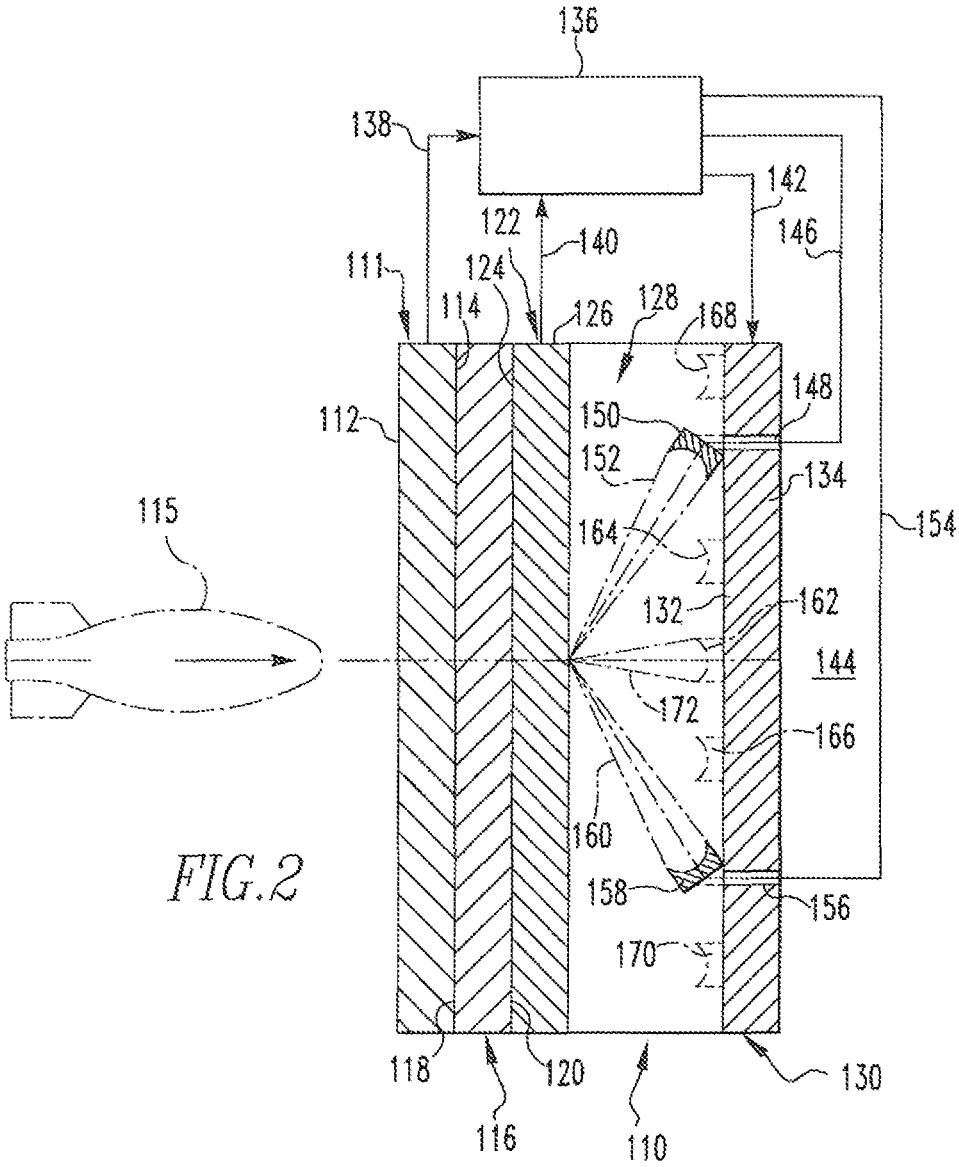
FIG. 2 is a vertical cross sectional view of a preferred embodiment of an alternate preferred embodiment of the present invention.

Referring to FIG. 2, another embodiment of the active armor system of the present invention is shown generally at numeral 110. This active armor system 110 includes a front armor layer 111 which would preferably consist of a suitable steel alloy or some other ferromagnetic material. The front armor layer 111 has a front face 112 and a rear face 114. The conventional shaped charge projectile 115, against which this system is designed to protect, travels in the direction of the arrow and would ordinarily be expected to impact against the front face 112 of the outer armor layer 111. Adjacent the front armor layer 111 there is an interior layer 116 which includes a front face and a rear face 120. This front face would abut the rear face of the front armor layer 111. The interior layer 116 is comprised of a suitable piezoelectric, electrostrictive, or magnetostrictive material, and specific preferred materials are disclosed in the above cited related U.S. application Ser. No. 10/871,146. For example, if a magnetostrictive material is selected, it would preferably be Terfernol which has a formula of Tb.sub0.27 Dy.sub0.73 Fe.sub2. Alternatively the magnetstrictive material may be a Terfernol-D alloy ("Doped" Terfernol) which has a formula of Tb.sub0.27.Dy.sub0 73 Fe.sub1.95 and which has an additive which is a Group III or Group IV element such as Si or Al. Other magnetostrictive materials which may be suitable include $TbFe_2$ and $SmFe_2$.

If a piezoelectric material is used, preferred piezoelectric ceramics would be barium titanate, lead zirconate titanate (PZT) and quartz. Other suitable piezoelectric ceramics may be strontium titanate, potassium tantalite niobate, potassium tantalite, lithium niobate, and barium sodium niobate. If an electrostrictive ceramic material is used, preferred materials would be lead magnesium niobate and lead titanate.

Inwardly adjacent the interior layer 116 there is an electrode 122 which has a front face 124 and a rear face 126. The front face 124 of electrode 122 would abut the rear face 120 of interior layer 116. Inwardly adjacent the rear face 126 of electrode 122 there is an interior air space 128. Alternatively, this air space 128 may be a vacuum space or may be a space filled with a inert gas. On the rear side of the armor system there is a rear armor layer 130 which has a front face 132 and a rear face 134. Armor layer 111 is electrically connected to solid state power converter 136 by line 138. Layer 126 is electrically connected to solid state power converter 136 by line 140. The front face 132 is adjacent air space 138 and the rear face 134 is adjacent a space to be protected 144 as, for example, the interior compartment of a tank or armored personnel carrier.

There is also a line 146 from power converter 136 to detonator 148 which is connected to shaped charge 150. Shaped charge 150 is tilted so that when it is detonated it produces an angularly oriented jet 152 which would intersect the jet (not shown) of the projectile 115 when projectile 115 strikes the outer armor layer 111. There is also a line 154 from power converter 136 to detonator 156 which is connected to shaped charge 158. Shaped charge 158 is tilted so that when it is detonated it produces an angularly oriented jet 160 which would intersect the jet (not shown) of the projectile 115 when projectile 115 strikes the outer armor layer 111. It will be seen that the jets 152 and 160 are interlocking so as to protect a relatively large area from projectile 115.

In operation, when a shaped charge projectile as, for example, projectile 115 impacts the front face 112 of the front armor layer 111, the force of that impact is transmitted through the front armor layer 111 to the interior layer 116. An electrical charge is transmitted to the electrode 122 which produces an electrical field which would tend to disrupt the jet (not shown) of the shaped charge of the projectile 115. Sufficient electrical current would also be produced to activate detonators 148 and 156 to detonate shaped charges 150 and 158 respectively to produce the interlocking jets 152 and 160 which would also disrupt the jet (not shown) from the projectile 115. It will be understood that the interlocking jets 152 and 160 may be used alone to disrupt the jet (not shown) from the projectile 115 in a system in which an electrical field in medal space 128 is not produced. There are also a plurality of additional shaped charges such as shaped charges 162, 164, 166, 168 and 170 mounted on inner armor layer 130 and perpendicularly oriented with respect to the medial space. In this embodiment shaped charges 162, 164, 166, 168, and 170 would not be detonated electrically, but instead could be detonated by the jet (not shown) of the projectile 115 in the event they would be contacted by that jet. If detonated, the jets from shaped charges 162, 164, 166, 168, and 170 would be in an opposite direction to the jet (not shown) of the projectile 115. For example, jet 172 would be produced in the event shaped charge 162 would be contacted by the jet (not shown) of the projectile 115. It will be understood that the shaped charges 162, 164, 166, 168, and 170 could be used in conjunction with shaped charges 150 and 158 so that if the jet (not shown) of the projectile was not sufficiently disrupted by interlocking jets 152 and 160, it would be further disrupted by jet 172. A system having such a dual layer of defensive jets might also be able to defeat a projectile having two successively detonated shaped charges.

It will be understood that in the foregoing described embodiment shown in FIG. 2 that it would be possible in various situations to delete the shaped charges 158 and 160 which are detonated by the electrically activated detonators 148 and 150 and substitute suitable shaped charges which would be detonated by the gas jet in an attacking projectile. In such an embodiment the interior layer 116 of a suitable piezoelectric, electrostrictive, magnetostrictive material and related circuitry between that material and the detonators could also, of course, be deleted.

It will be appreciated that an active armor system has been described which is adapted for use on a lightly armored vehicle or retrofitted onto an unarmored vehicle since the amount of explosive used in a relatively small number of shaped charges which might be detonated by a projectile attacking the vehicle would be relatively small as compared with a relatively large explosive layer used in prior art reactive armor systems. Furthermore, in the active armor system of this invention any detonation of the shaped charges incorporated into the armor system would be directed away from the occupants of the vehicle.

While the present invention has been described in connection with the preferred embodiments of the various figures, it is to be understood that other similar embodiments may be used or modifications and additions may be made to the described embodiments for performing the same function of the present invention without deviating therefrom. Therefore, the present invention should not be limited to any single embodiment, but rather construed in breadth and scope in accordance with the recitation of the appended claims.

What is claimed is:

1. An active armor system comprising:

an outer and an inner armor layer with a medial space between said outer and inner armor layers;

a defensive shaped charge positioned in the medial space, such that if the outer armor layer is attacked by an ordnance having an offensive shaped charge, said defensive shaped charge is detonated to degrade the effectiveness of the offensive shaped charge, wherein the offensive shaped charge forms an offensive jet and the detonation of the defensive shaped charge forms a defensive jet which is substantially oppositely directed to the offensive jet to disrupt the offensive jet inside the medial space, and said defensive shaped charge in the medial space is detonated as a result of being contacted by the offensive jet.

2. The active armor system of claim 1 wherein said defensive shaped charge in the medial space is used in conjunction with an electrical or magnetic field to disrupt the offensive jet of said offensive shaped charge.

3. The active armor system of claim 1 wherein a second defensive shaped charge in the medial space is positioned on the inner armor layer in tilted relation to the inner armor layer to produce a second defensive jet which intersects the offensive jet.

4. The active armor system of claim 3 wherein a third defensive shaped charges in the medial space is positioned on the inner armor layer in tilted relation to the tilted armor layer to produce a third defensive jet and the second and third defensive shaped charges are tilted relative to each other so that the second and third defensive jets intersect with each other and also with the offensive jet.

5. The active armor system of claim 1 wherein said defensive shaped charge in the medial space is positioned on the inner armor layer in flush abutting relation to the inner armor layer to produce the defensive jet which is substantially in an opposed direction to the offensive jet.

6. The active armor system of claim 1 wherein there are a plurality of additional defensive shaped charges in the medical space positioned on the inner armor layer in flush abutting relation to the inner armor layer to produce additional defensive jet which are in a substantially opposed direction to the offensive jet.

* * * * *